US008584749B2

(12) United States Patent
Troshko et al.

(10) Patent No.: US 8,584,749 B2
(45) Date of Patent: Nov. 19, 2013

(54) SYSTEMS AND METHODS FOR DUAL REINJECTION

(75) Inventors: Andrey A. Troshko, Pearland, TX (US); Sergio A. Leonardi, Pearland, TX (US); David P. Yale, Milford, NJ (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 13/289,760

(22) Filed: Nov. 4, 2011

(65) Prior Publication Data

US 2012/0152534 A1 Jun. 21, 2012

(51) Int. Cl.
*E21B 43/00* (2006.01)

(52) U.S. Cl.
USPC ..... 166/268; 166/369; 166/75.15

(58) Field of Classification Search
USPC ..... 166/268, 369, 75.15, 265, 266, 267, 166/275, 52
See application file for complete search history.

(56) References Cited

U.S. PATENT DOCUMENTS

| | | | |
|---|---|---|---|
| 3,340,824 | A | 9/1967 | Talbot |
| 3,440,824 | A | 4/1969 | Doolin |
| 3,508,407 | A | 4/1970 | Booth |
| 3,608,317 | A | 9/1971 | Landau |
| 3,786,639 | A | 1/1974 | Pineno et al. |
| 4,101,333 | A | 7/1978 | Wayment |
| 4,398,769 | A | 8/1983 | Jacoby |
| 4,406,449 | A | 9/1983 | Buck |
| 4,437,706 | A | 3/1984 | Johnson |
| 4,452,491 | A | 6/1984 | Seglin et al. |
| 4,550,779 | A | 11/1985 | Zakiewicz |
| 4,575,155 | A | 3/1986 | Hodges |
| 4,942,929 | A | 7/1990 | Malachosky et al. |
| 4,946,597 | A | 8/1990 | Sury |
| 4,968,187 | A | 11/1990 | Burnett |
| 5,095,982 | A | 3/1992 | Peng et al. |
| 5,124,008 | A | 6/1992 | Rendall et al. |
| 5,129,469 | A | 7/1992 | Jackson |

(Continued)

FOREIGN PATENT DOCUMENTS

| | | |
|---|---|---|
| CA | 1017368 | 9/1977 |
| CA | 1018556 | 10/1977 |

(Continued)

OTHER PUBLICATIONS

Chilton, R.A. et al., (1998) "Pressure loss equations for laminar and turbulent non-Newtonian pipe flow," *Journal of Hydraulic Engineering*, 124 (5), 522-529.

(Continued)

*Primary Examiner* — Kenneth L Thompson
*Assistant Examiner* — Taras P Bemko
(74) *Attorney, Agent, or Firm* — ExxonMobil Upstream Research Company—Law Department

(57) ABSTRACT

Methods for hydrocarbon recovery from a subsurface formation include removing a mixture comprising hydrocarbons and particulate solids from a first formation. At least a portion of the hydrocarbons are separated from the particulate solids. The particulate solids are separated into a plurality of streams. A mixed slurry comprising a first portion of the plurality of streams is injected through a first pipe into the first formation. A waste stream comprising a second portion of the plurality of streams is injected through a second pipe into a second formation. The first formation and the second formation lie in a substantially vertical line.

28 Claims, 8 Drawing Sheets

200

(56) References Cited

U.S. PATENT DOCUMENTS

| | | | | |
|---|---|---|---|---|
| 5,141,365 | A | 8/1992 | Smart | |
| 5,253,707 | A | 10/1993 | Schmidt et al. | |
| 5,310,285 | A | 5/1994 | Northcott | |
| 5,335,732 | A | 8/1994 | McIntyre | |
| 5,431,236 | A | 7/1995 | Warren | |
| 5,593,248 | A | 1/1997 | Kansa et al. | |
| 5,743,334 | A | 4/1998 | Nelson | |
| 5,823,631 | A | 10/1998 | Herbolzheimer et al. | |
| 6,152,356 | A | 11/2000 | Minden | |
| 6,168,352 | B1 | 1/2001 | Chen et al. | |
| 6,297,295 | B1 | 10/2001 | Gay et al. | |
| 6,431,796 | B1 | 8/2002 | Goldsack et al. | |
| 6,481,500 | B1 | 11/2002 | Burd et al. | |
| 6,651,742 | B2 | 11/2003 | Burd et al. | |
| 6,679,326 | B2 | 1/2004 | Zakiewicz | |
| 6,904,326 | B2 | 6/2005 | Lopez et al. | |
| 6,929,330 | B2 | 8/2005 | Drake et al. | |
| 7,069,990 | B1 | 7/2006 | Bilak | |
| 7,104,320 | B2 | 9/2006 | Buchanan et al. | |
| 7,571,080 | B2 | 8/2009 | Guo et al. | |
| 7,575,072 | B2 | 8/2009 | Reddoch, Sr. | |
| 7,730,996 | B2 | 6/2010 | Van De Flier et al. | |
| 2008/0122286 | A1 | 5/2008 | Brock et al. | |
| 2008/0135241 | A1 | 6/2008 | Iqbal et al. | |
| 2009/0200024 | A1 * | 8/2009 | Ayasse et al. | 166/261 |
| 2009/0236103 | A1 | 9/2009 | Yale et al. | |
| 2011/0120704 | A1 | 5/2011 | Best | |
| 2011/0315397 | A1 | 12/2011 | Best | |

FOREIGN PATENT DOCUMENTS

| | | |
|---|---|---|
| CA | 1053573 | 5/1979 |
| CA | 1151529 | 8/1983 |
| CA | 1186987 | 5/1985 |
| CA | 2055549 | 5/1993 |
| CA | 2423232 | 4/2002 |
| CA | 2491942 | 1/2004 |
| CA | 2277528 | 7/2006 |
| WO | WO 99/45228 | 9/1999 |
| WO | WO 2006/138565 | 12/2006 |
| WO | WO 2007/028996 | 3/2007 |
| WO | WO 2007/050180 | 5/2007 |
| WO | WO 2008/064305 | 5/2008 |
| WO | WO 2009/009887 | 1/2009 |
| WO | WO 2009/114146 | 9/2009 |
| WO | WO 2010/000729 | 1/2010 |

OTHER PUBLICATIONS

Cooke, R. (2001) "Design procedure for hydraulic backfill distribution systems," *The Journal of the South African Institute of Mining and Metallurgy*, Mar./Apr., pp. 97-102.

Corti et al., (1988) "Athabasca Mineable Oil Sands: The RTR/Gulf Extraction Process Theoretical Model of Bitumen Detachment," *The 4th UNITAR/UNDP International Conference on Heavy Crude and Tar Sands Proceedings*, vol. 5, Edmonton, AB, Aug. 7-12, pp. 41-44, 71.

Guo, Q., et al., (2004) "An Overview of Drill Cuttings Reinjection—Lessons Learned and Recommendations," *11th International Petroleum Environmental Conference*, Albuquerque, New Mexico, Oct. 12-15.

Mangesana, N., et al., (2008) "The effect of particle sizes and solids concentration on the rheology of silica sand based suspensions," *Journal of the Southern African Institute of Mining and Metallurgy*, 108, 237-243.

Diamond, Jared (2005). Collapse. Penguin, 452-459.

* cited by examiner

100

200

300

400

500

600

700

800

SYSTEMS AND METHODS FOR DUAL REINJECTION

CROSS-REFERENCE TO RELATED APPLICATION

This application claims the priority benefit of U.S. Provisional Patent Application 61/424,468 filed 17 Dec. 2010 entitled SYSTEMS AND METHODS FOR DUAL REINJECTION, the entirety of which is incorporated by reference herein.

FIELD

The present techniques relate to waste disposal of a tailings stream. More specifically, methods and systems are disclosed for dual reinjection of a slurry mixture and a waste stream into a rock formation.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Modern society is greatly dependent on the use of hydrocarbons for fuels and chemical feedstocks. Hydrocarbons are generally found in subsurface rock formations that can be termed "reservoirs." Removing hydrocarbons from the reservoirs depends on numerous physical properties of the rock formations, such as the permeability of the rock containing the hydrocarbons, the ability of the hydrocarbons to flow through the rock formations, and the proportion of hydrocarbons present, among others.

Easily harvested sources of hydrocarbon are dwindling, leaving less accessible sources to satisfy future energy needs. However, as the costs of hydrocarbons increase, these less accessible sources become economically attractive. Recently, the harvesting of oil sands to remove bitumen has become more economical. Hydrocarbon removal from the oil sands may be performed by several techniques. For example, a well can be drilled to an oil sand reservoir and steam, hot air, solvents, or a combination thereof, can be injected to release the hydrocarbons. The released hydrocarbons may then be collected and brought to the surface. In another technique, strip or surface mining may be performed to access the oil sands, which can then be treated with hot water or steam to extract the oil. However, this technique produces a substantial amount of waste or tailings that must be disposed. Traditionally in the oil sand industry, tailings have been disposed of in tailings ponds.

Recent studies have been published that address the treatment of tailings as they are produced, in order to avoid the need for the large settling and storage areas. For example, International Patent Publication No. WO/2009/009887, by Bozak, et al., discloses a method for the recovery of tailings ponds. The method allows for treating tailings comprising a solids fraction and a hydrocarbon fraction. In the method, a primary flow is supplied to a jet pump. The primary flow includes water and less than 20% solids by mass. A secondary flow is supplied to a mixing chamber of the jet pump. The secondary flow includes a slurry of water and tailings, in which the slurry includes more solids by mass than the primary flow. The jet pump is operated using the primary flow such that the tailings are agitated to effect at least a partial phase separation of the hydrocarbon fraction from the tailings.

However, the recovery and treatment of these ponds may still add substantial costs to the production of hydrocarbons. Accordingly, processes that generate less waste may be useful. For example, one process for harvesting oil sands that generates less surface waste is the slurrified hydrocarbon extraction process. In the slurrified hydrocarbon extraction process, the entire contents of a reservoir, including sand and hydrocarbon, can be extracted from the subsurface via wellbore for processing at the surface to remove the hydrocarbons. The tailings are then reinjected via wellbores back into the subsurface to prevent subsidence of the reservoir and to allow the re-injected material to sweep the hydrocarbon bearing sands from the reservoir to the wellbore producing the slurry.

U.S. Pat. No. 5,823,631 to Herbolzheimer et al. discloses one such slurrified hydrocarbon recovery process that uses a slurry that is injected into a reservoir. In this process, hydrocarbons that are trapped in a solid media, such as bitumen in tar sands, can be recovered from deep formations. The process is performed by relieving the stress of the overburden and causing the formation to flow from an injection well to a production well, for example, by fluid injection. A tar sand/water mixture is recovered from the production well. The bitumen is separated from the sand and the remaining sand is reinjected in a water slurry.

International Patent Application No. WO/2007/050180, by Yale and Herbolzheimer, discloses an improved slurrified heavy oil recovery process. The application discloses a method for recovering heavy oil that includes accessing a subsurface formation from two or more locations. The formation may include heavy oil and one or more solids. The formation is pressurized to a pressure sufficient to relieve the overburden stress. A differential pressure is created between the two or more locations to provide one or more high pressure locations and one or more low pressure locations. The differential pressure is varied within the formation between the one or more high pressure locations and the one or more low pressure locations to mobilize at least a portion of the solids and a portion of the heavy oil in the formation. The mobilized solids and heavy oil then flow toward the one or more low pressure locations to provide a slurry comprising heavy oil, water and one or more solids. The slurry comprising the heavy oil and solids is flowed to the surface where the heavy oil is recovered from the one or more solids. The one or more solids are recycled to the formation, for example, as backfill.

The method discussed above converts the hydrocarbon bearing reservoir into a formation resembling a moving bed. When the reservoir moves toward the producer wells, void space is filled by the reinjected clean slurry stream. A critical aspect of the method is that this reinjected stream must have permeability that is higher than the relative permeability to water of the target formation. The slurry is not pushed, but rather dragged by the percolating fluid flow. Such methods may be considered a subset of a wider group of techniques used to inject tailings or wastes into subsurface spaces, such as mines and formations.

Backfill systems for reinjection of tailings in mining operations fall into two major flow categories. See Cooke, "Design procedure for hydraulic backfill distribution systems," The Journal of The South African Institute of Mining and Metallurgy, March/April 2001, pp. 97-102 (hereinafter "Cooke 2001"). The first category is a free fall flow and the second category is a full flow or continuous flow.

The free fall flow systems are categorized by low flow rates such that gravity force is larger than friction force on a slurry, so that the slurry falls freely in the pipe until it reaches the free surface. The advantage of such a system is its tolerance to variations in tailings stream properties, such as solids volume concentration and flow rate. However, the backfilling pipes may often have a short life span. The reasons behind the short pipe life span include the impact damage of slurry freely falling with speed of up to 45 m/s, high impact pressure when slurry hits the free surface, high erosion rates when slight deviations from vertical occur in free fall region, and excessive pressure in the event of pipeline blockage.

The continuous flow systems are categorized by slurry occupying the full length of the reinjection well and the pipelines without any area of free fall. The advantage of this method is a much larger pipe life span as the free fall associated modes of pipe wear may be decreased. However, a fairly high backfill flow rate must be maintained so that friction loss is equal or greater than the backfill weight. Such systems may be sensitive to changes in flow rate and slurry rheology. Therefore, friction regulating/augmenting devices and techniques, such as liners, valves, breaks or, more often, solids volume concentration regulation are common. However, if the formation in the immediate vicinity of the injection represents a significant resistance to the backfill flow, then a large backpressure will develop which will support the weight of the backfill.

Most modern backfilling systems in mining operations are of the continuous type. Generally, hydraulic backfills are classified as slurries and pastes. See Cooke 2001. Slurries are characterized by low fraction of small particles or fines, for example, less than about 75 μm, and volume concentrations equal or lower than particle constant contact solid concentration, i.e., the volume concentration at or above which particles start developing permanent contacts with each other. Pastes, on the other hand, have large fines content and volume concentrations exceeding constant contact solid concentration, for example, about 45-50%.

The permeability of a slurry can be controlled by its water content, the average particle size and also the particle size distribution. See Mangesana, N., et al., "The effect of particle sizes and solids concentration on the rheology of silica sand based suspensions," Journal of the Southern African Institute of Mining and Metallurgy, 108, 237-243 (2008). In particular, the smaller particles have the largest effect for the permeability control and, therefore, play a leading role into the design of any reinjection system. Several schemes have been suggested in the literature to address fluid rheology by particle size distribution or water content control. Previous art in this area is strongly related to particle size control and slurry distribution systems.

As suggested above, many efforts have been made previously in this area. Among the prior U.S. patents related to the technology disclosed herein, the following non-exclusive list is representative of those efforts: U.S. Pat. Nos. 3,508,407; 4,101,333; 5,141,365; 6,168,352; and 6,297,295.

These conventional prior systems for backfilling generally rely on an existing underground cavity. A borehole is drilled from the surface down to the underground cavity and fill material is then fed into the cavity either directly through the borehole or through a conduit placed in the borehole. It is often necessary to drill a number of such boreholes spaced a predetermined distance apart and to backfill through each of the holes to ensure that the underground cavity is filled as best is possible. The number of holes required is dependent upon the manner and degree to which the fill material is distributed in the cavity from the borehole. For example, in many systems, a slurry of fill material such as water and fine solids is merely deposited vertically into the cavity and is distributed in pyramidal fashion. This has been unsatisfactory in at least two respects. First, the slurry is not distributed very far laterally, thus a large number of boreholes are required. Second, after settlement of the slurry material, some top areas of the underground cavity remain unfilled and cave-ins continue to occur above those areas. Several improvements have been suggested in the literature. For example, U.S. Pat. Nos. 3,440,824; 3,608,317; 3,786,639; 4,968,187; and 6,431,796 are representative improvements.

In addition to the use of the backfill for mining purposes, numerous studies have focused on the use of backfill techniques to dispose of wastes. The disposal of the drill cuttings and drilling mud can be a complex environmental problem. Traditional methods of disposal include dumping, bucket transport, conveyor belts, screw conveyors, and washing techniques that require large amounts of water. Adding water creates additional problems of added volume and bulk, pollution, and transport problems. Installing conveyors may require major modification to a rig area and may involve extensive installation hours and expense.

Drilling waste injection or cuttings disposal into a subsurface formation has several advantages. For example no waste may be left on the surface. Transportation risks may be decreased or eliminated. There may be no liabilities for further clean-up once the disposal well is plugged. All of these advantages may improve the economics of a process. See Guo, Q. and Geehan, T., "An Overview of Drill Cuttings Reinjection—Lessons Learned and Recommendations," 11th International Petroleum Environmental Conference, Albuquerque, N. Mex., Oct. 12-15, 2004.

Cuttings reinjection typically consists in a shearing and grinding system that converts the cuttings into a viscous slurry with the addition of water. The slurry is then injected by means of a high pressure pump, through hydraulic fracturing, into the subsurface using a well that extends relatively deep underground into a receiving stratum or adequate geological formation. The basic steps in the process can include the identification of an appropriate stratum or formation for the injection, preparing an appropriate injection well, formulation of the slurry, performing the injection operations, which may include fracturing the formation, and capping the well.

Related information on the reinjection of waste tailings may be found in U.S. Pat. Nos. 4,942,929; 5,129,469; 7,069,990; 7,730,996; 7,571,080; 5,310,285; 5,431,236; and 7,575,072 among many others. However, none of the techniques discusses the multiple simultaneous injections of a first slurry for harvesting subsurface materials and a second slurry that comprises a waste stream.

SUMMARY

An embodiment of the present techniques provides a method for disposing of waste during a hydrocarbon recovery process. The method includes removing a mixture comprising hydrocarbons and particulate solids from a reservoir formation and separating at least a portion of the hydrocarbons from the particulate solids. The mixture of hydrocarbons and particulate solids can be removed from the first formation using a slurrification process. The particulate solids are separated into a plurality of streams. A mixed slurry including a first portion of the plurality of streams is injected through a first pipe into the reservoir formation. A waste stream including a second portion of the plurality of streams is injected through a second pipe into a target formation, wherein the reservoir formation and the target formation lie in a substantially vertical line. Deformation at the surface in a substantially vertical line above the first formation may be monitored and injection into the target formation can be controlled to minimize the surface deformation.

Particulates obtained from another source can be incorporated into the waste stream prior to injection. The mixed slurry, the waste stream, or both can be injected intermittently. Water injected with the waste stream can be minimized. The mixed slurry, the waste stream, or both can be formed from brine. Water may be added to the mixed slurry to control a rheological property of the mixed slurry, the density of the mixed slurry, or both. Water may be added to the waste stream to control a rheological property of the waste stream, the density of the waste stream, or both. Water may also be removed from the waste stream to control a rheological property of the waste stream, the density of the waste stream, or both.

The waste stream may be injected into the reservoir formation below the injection of the slurry mixture. Coarse particles may be added to the waste stream to control a permeability of the waste stream.

Another embodiment provides a system for harvesting hydrocarbons from a reservoir. The system includes a production well configured to convey a mixture from a reservoir formation, wherein the mixture comprises hydrocarbons and particulate materials. A separation system is configured to separate the particulate materials into a plurality of tailings streams. A mixing system is configured to form a slurry mixture from a portion of the plurality of tailings streams and a waste stream from an excess portion of at least one of the plurality of tailings stream. A first injection pipe is configured to inject the mixed slurry into the reservoir formation. A second injection pipe is configured to inject a waste stream into a target formation.

The separation system can be configured to separate the hydrocarbons from the particulate materials. The first injection pipe and the second injection pipe may be placed in a single wellbore. The plurality of tailings streams may include a coarse tailings stream and a fine tailings stream. The mixing system can be configured to adjust a water content of the slurry mixture to achieve a target density. Brine may be used as a water source.

The target formation for injecting the waste stream may be the reservoir formation. The waste stream may be injected into the reservoir formation below the slurry mixture. In addition to, or instead of the reservoir formation, the target formation may be a formation located substantially vertically below the reservoir formation.

The reservoir formation may include bitumen. At least one of the mixed slurry or the waste stream may include residual hydrocarbons.

Another embodiment provides a method for harvesting hydrocarbons from a reservoir. The method includes drilling at least one injection well to a reservoir formation and drilling at least one production well to the reservoir formation. A material is produced from the production well, wherein the material includes a mixture of particulate solids and hydrocarbons. At least a portion of the hydrocarbons are removed from the material to form a plurality of particulate streams. A mixture is formed that includes a portion of the plurality of particulate streams, wherein the ratio of each of the plurality of particulate streams in the mixture is controlled to control a permeability of the mixture. A water content of the mixture is controlled to control a rheological property of the mixture. The mixture is injected through the injection well into the reservoir at substantially the same rate as production of the material from the reservoir. A waste stream including an unused portion of the plurality of particulate streams is injected through an injection pipe.

The portion of the hydrocarbons removed from the material may be processed. A separate injection well may be drilled to a target formation for injecting the waste stream. The waste stream and the mixture can be injected through separate pipes that are co-located in a single wellbore.

DESCRIPTION OF THE DRAWINGS

The advantages of the present techniques are better understood by referring to the following detailed description and the attached drawings, in which.

DETAILED DESCRIPTION

Figure 1:
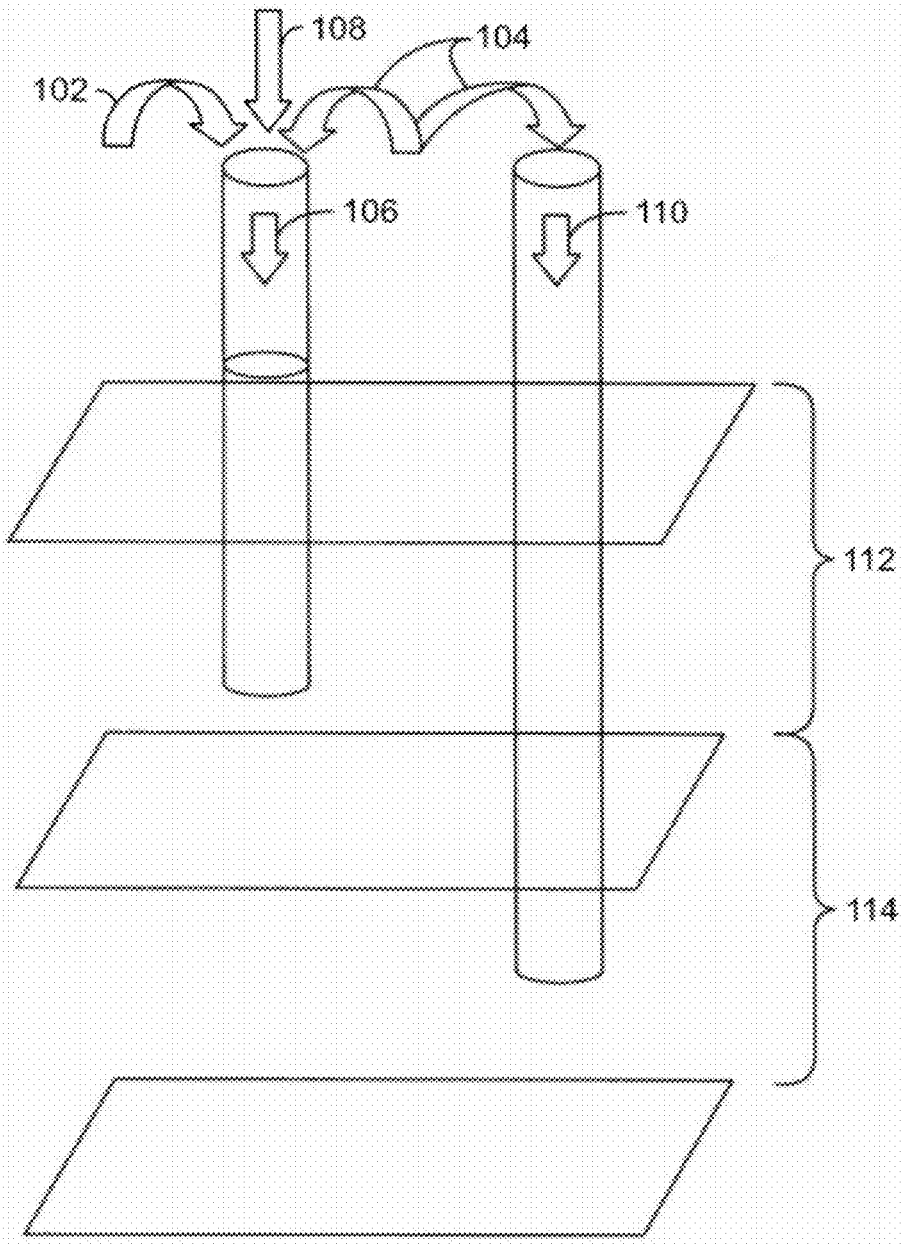
FIG. 1 is a diagram showing an embodiment of a slurry stream mixing and injection process.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

"Bitumen" is a naturally occurring heavy oil material. Generally, it is the hydrocarbon component found in oil sands. Bitumen can vary in composition depending upon the degree of loss of more volatile components. It can vary from a very viscous, tar-like, semi-solid material to solid forms. The hydrocarbon types found in bitumen can include aliphatics, aromatics, resins, and asphaltenes. A typical bitumen might be composed of:

19 wt. % aliphatics (which can range from 5 wt. %-30 wt. %, or higher);

19 wt. % asphaltenes (which can range from 5 wt. %-30 wt. %, or higher);

30 wt. % aromatics (which can range from 15 wt. %-50 wt. %, or higher);

32 wt. % resins (which can range from 15 wt. %-50 wt. %, or higher); and some amount of sulfur (which can range in excess of 7 wt. %).

In addition bitumen can contain some water and nitrogen compounds ranging from less than 0.4 wt. % to in excess of 0.7 wt. %. The metals content, while small, must be removed to avoid contamination of the product synthetic crude oil (SCO). Nickel can vary from less than 75 ppm (part per million) to more than 200 ppm. Vanadium can range from less than 200 ppm to more than 500 ppm. The percentage of the hydrocarbon types found in bitumen can vary.

"Clark hot water extraction process" ("CHWE") was originally developed for releasing bitumen from oil sands, based on the work of Dr. K. A. Clark, and discussed in a paper by Corti et al., "Athabasca Mineable Oil Sands: The RTR/Gulf Extraction Process Theoretical Model of Bitumen Detachment," The 4th UNITAR/UNDP International Conference on Heavy Crude and Tar Sands Proceedings, vol. 5, Edmonton, AB, Aug. 7-12, 1988, pp. 41-44, 71. The process, which is also described in U.S. Pat. No. 4,946,597, uses vigorous mechanical agitation of the oil sands with water and caustic alkali to disrupt the granules and form a slurry, after which the slurry is passed to a separation tank for the flotation of the bitumen, or other hydrocarbons, from which the bitumen is skimmed. The process may be operated at ambient temperatures, with a conditioning agent being added to the slurry. Earlier methods used temperatures of 85° C., and above, together with vigorous mechanical agitation and are highly energy inefficient. Chemical adjuvants, particularly alkalis, have to be utilized to assist these processes.

The "front end" of the CHWE, leading up to the production of cleaned, solvent-diluted bitumen froth, will now be generally described. The as-mined oil sand is firstly mixed with hot water and caustic in a rotating tumbler to produce a slurry. The slurry is screened, to remove oversize rocks and the like. The screened slurry is diluted with additional hot water and the product is then temporarily retained in a thickener vessel, referred to as a primary separation vessel ("PSV"). In the PSV, bitumen globules contact and coat air bubbles which have been entrained in the slurry in the tumbler. The buoyant bitumen-coated bubbles rise through the slurry and form a bitumen froth. The sand in the slurry settles and is discharged from the base of the PSV, together with some water and a small amount of bitumen. This stream is referred to as "PSV underflow." "Middlings," including water containing non-buoyant bitumen and fines, collect in the mid-section of the PSV.

The froth overflows the lip of the vessel and is recovered in a launder. This froth stream is referred to as "primary" froth. It typically comprises 65 wt. % bitumen, 28 wt. % water, and 7 wt. % particulate solids.

The PSV underflow is introduced into a deep cone vessel, referred to as the tailings oil recovery vessel ("TORV"). Here the PSV underflow is contacted and mixed with a stream of aerated middlings from the PSV. Again, bitumen and air bubbles contact and unite to form buoyant globules that rise and form a froth. This "secondary" froth overflows the lip of the TORV and is recovered. The secondary froth typically comprises 45 wt. % bitumen, 45 wt. % water, and 10 wt. % solids. The underflows from the TORV, the flotation cells and the dilution centrifuging circuit are typically discharged as tailings into a pond system. As used herein, the tailings are sources of particulate streams that may be separated into two or more substreams, for example, including particles of different sizes. Any discussions of particles will include tailings and vice-versa. In embodiments of the present techniques, the tailings are reinjected back into the formation as backfill. The reinjection both prevents subsidence as material is removed from the reservoir and also lowers environmental issues from the waste tailings. Water removed from the tailings during the reinjection process may be recycled for use as plant process water.

As used herein, a "compressor" includes any type of equipment designed to increase the pressure of a material, and includes any one type or combination of similar or different types of compression equipment. A compressor may also include auxiliary equipment associated with the compressor, such as motors, and drive systems, among others. The compressor may utilize one or more compression stages, for example, in series. Illustrative compressors may include, but are not limited to, positive displacement types, such as reciprocating and rotary compressors for example, and dynamic types, such as centrifugal and axial flow compressors, for example.

"Facility" as used in this description is a tangible piece of physical equipment through which hydrocarbon fluids are either produced from a reservoir or injected into a reservoir, or equipment which can be used to control production or completion operations. In its broadest sense, the term facility is applied to any equipment that may be present along the flow path between a reservoir and its delivery outlets. Facilities may comprise production wells, injection wells, well tubulars, wellhead equipment, gathering lines, manifolds, pumps, compressors, separators, surface flow lines, sand processing plants, and delivery outlets. In some instances, the term "surface facility" is used to distinguish those facilities other than wells. A "facility network" is the complete collection of facilities that are present in the model, which would include all wells and the surface facilities between the wellheads and the delivery outlets.

A "hydrocarbon" is an organic compound that primarily includes the elements hydrogen and carbon, although nitrogen, sulfur, oxygen, metals, or any number of other elements may be present in small amounts. As used herein, hydrocarbons generally refer to components found in bitumen, or other oil sands.

"Permeability" is the capacity of a rock to transmit fluids through the interconnected pore spaces of the rock; the customary unit of measurement is the millidarcy. The term "relatively permeable" is defined, with respect to formations or portions thereof, as an average permeability of 10 millidarcy or more (for example, 10 or 100 millidarcy). The term "relatively low permeability" is defined, with respect to formations or portions thereof, as an average permeability of less than about 10 millidarcy. While permeability is typically considered in the context of a solid object, such as rock, it may also be relevant in the context of non-solid materials. For example, in the context of the present technology, the slurries injected into the formation are adapted to have selected permeabilities relative to the formation fluids. In some implementations, the slurries may be adapted to have low permeabilities relative to the formation fluids to push the formation fluids in front of the injected slurries rather than allowing the formation fluids to pass into or through the injected slurries.

"Pressure" is the force exerted per unit area by the gas on the walls of the volume. Pressure can be shown as pounds per square inch (psi). "Atmospheric pressure" refers to the local pressure of the air. "Absolute pressure" (psia) refers to the sum of the atmospheric pressure (14.7 psia at standard conditions) plus the gage pressure (psig). "Gauge pressure" (psig) refers to the pressure measured by a gauge, which indicates only the pressure exceeding the local atmospheric pressure (i.e., a gauge pressure of 0 psig corresponds to an absolute pressure of 14.7 psia). The term "vapor pressure" has the usual thermodynamic meaning For a pure component in an enclosed system at a given pressure, the component vapor pressure is essentially equal to the total pressure in the system.

Figure 7:
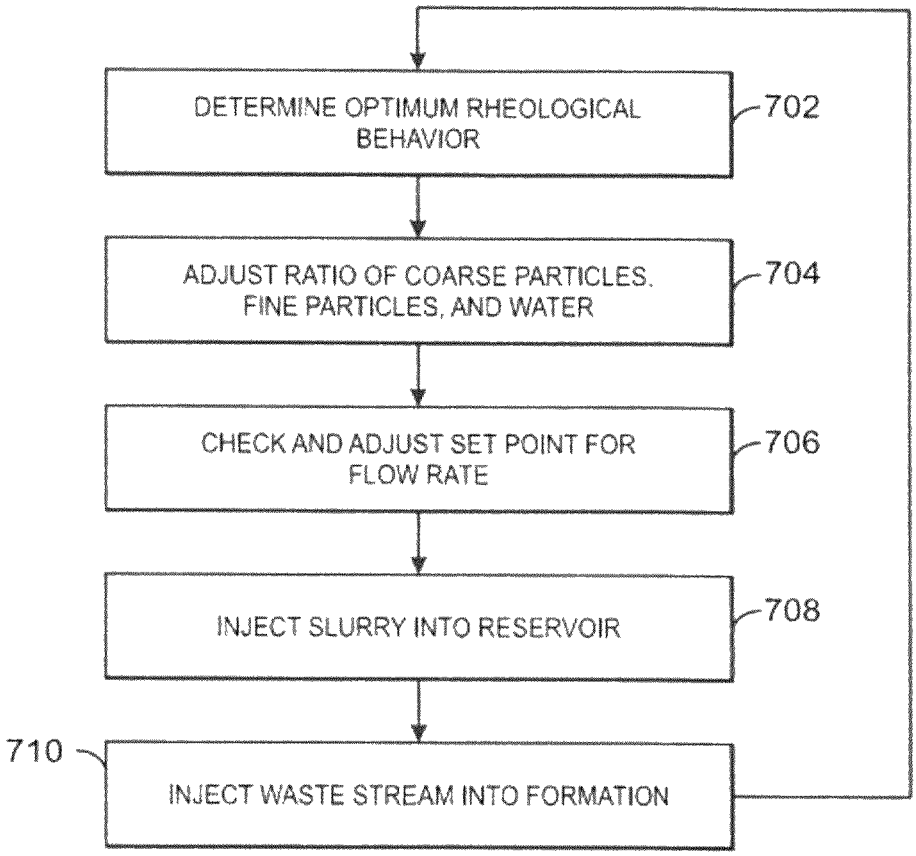
FIG. 7 is a block diagram of a method for dual injection of a mixed slurry and a waste slurry.
Figure 8:
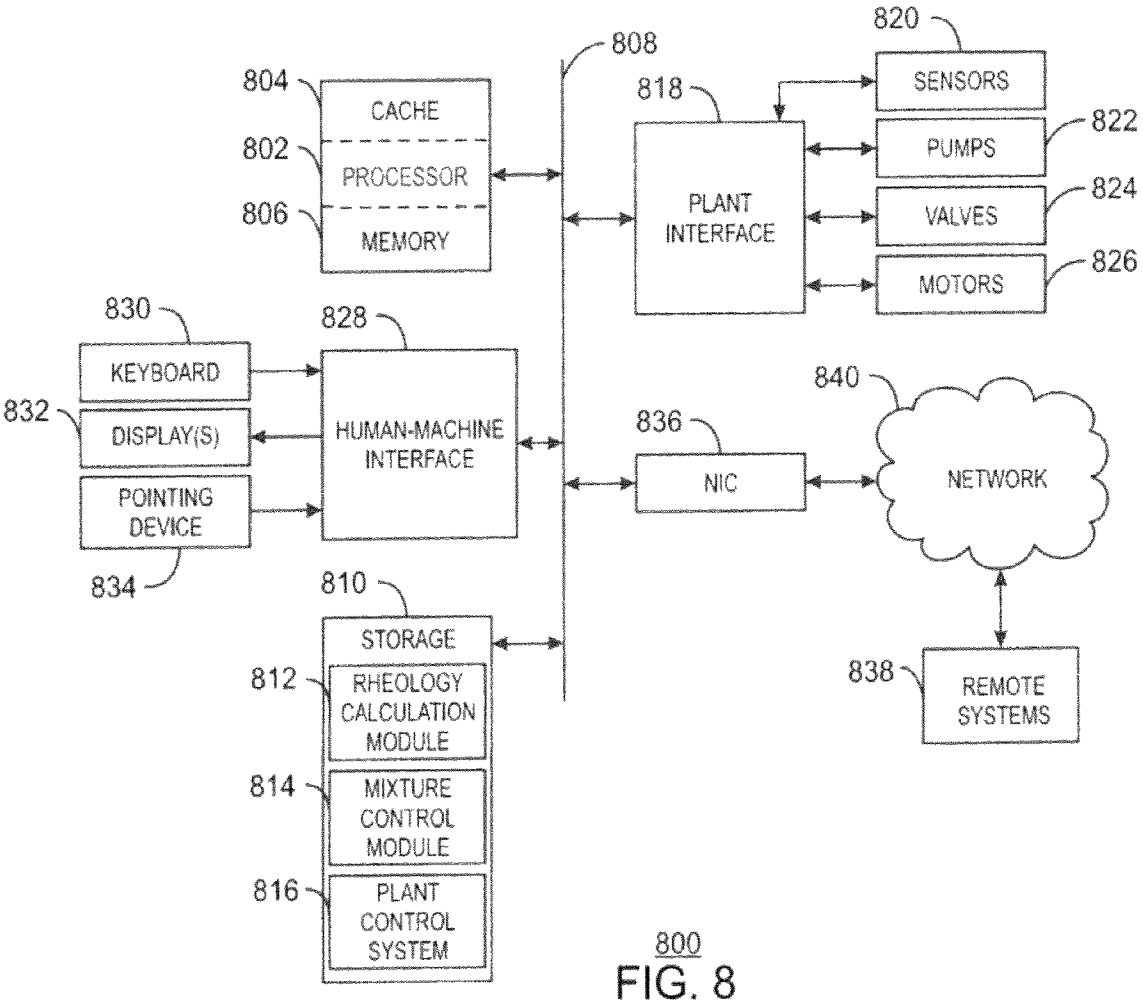
FIG. 8 is a block diagram of a control system 800 that may be used to control a backfill and waste injection process.

As used herein, "pressure gradient" represents the increase in back pressure seen when a flow rate of a fluid or slurry is increased. FIGS. 7 and 8 illustrate the application of pressure gradient versus superficial velocity for slurries. Pressure gradient may be measured by the methods described by Chilton, R. A. and Stainsby, R. "Pressure loss equations for laminar and turbulent non-Newtonian pipe flow," Journal of Hydraulic Engineering, 124 (5), 522-529 (1998).

As used herein, a "reservoir" is a subsurface rock formation from which a production fluid can be harvested. The rock formation may include granite, silica, carbonates, clays, and organic matter, such as oil, gas, or coal, among others. Reservoirs can vary in thickness from less than one foot (0.3048 m) to hundreds of feet (hundreds of m). The permeability of the reservoir provides the potential for production. As used herein a reservoir may also include a hot dry rock layer used for geothermal energy production. A reservoir may often be located at a depth of 50 meters or more below the surface of the earth or the seafloor.

A "rheological property" can include numerous stress-strain relationships, such as viscosity, deformation rates, flow rates, creep rates, elasticity, plasticity, and any other properties of a material under an applied strain. Such properties are discussed, for example, with respect to FIG. 4, below.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

A "wellbore" is a hole in the subsurface made by drilling or inserting a conduit into the subsurface. A wellbore may have a substantially circular cross section or any other cross-sectional shape, such as an oval, a square, a rectangle, a triangle, or other regular or irregular shapes. As used herein, the term "well", when referring to an opening in the formation, may be used interchangeably with the term "wellbore." Further, multiple pipes may be inserted into a single wellbore, for example, to limit frictional forces in any one pipe.

Overview

For effective injection of tailings in a backfilling process, such as a slurrified heavy oil recovery process, two conditions may be met. First, the permeability of the backfill solids can be controlled within a predetermined range. Second, the solids flow rate can be controlled within a range as well. When both criteria are met, the backfill may be placed correctly, water consumption can be optimal, and subsidence may be prevented. As tailing streams in real injection processes may vary over time, a control system may run a mathematical algorithm to vary the concentrations of various mixtures to control these parameters. In harvesting material from a subsurface reservoir, such as using a slurrified heavy oil recovery process, generally two or more tailings streams are obtained.

One tailings stream that can be obtained may include fine particles (e.g., less than about 75 μm) and another tailings stream may include coarse particles (e.g., greater than about 44 μm). The fine tailings stream may be blended with the coarse tailings stream to form a mixed slurry stream with control over permeability and density being provided by the mixture concentrations. However, since the finer-grain in the fine tailings stream can affect the mixture permeability the most, conditions may exist under which the desired mixture properties cannot be achieved while using all of both streams. This is typically the result when the fines exceed a certain threshold of the recovered tailings. Under those circumstances, the excess fines have to be disposed of by other methods. Thus, tailings ponds may still be needed to dispose of the fine particles.

Embodiments described herein provide methods and systems for disposing of an unwanted tailings stream in a subsurface formation. The unwanted tailings stream may include, for example, the excess fines stream, a waste stream from another drilling operation, mine tailings, and the like. The method uses a dual or separate injection process, for example, in the slurrified heavy oil recovery process. The single reinjection or backfilling stream in a normal injector well is replaced by two separate streams: a backfilling stream that has a desired permeability, and a waste stream of excess fine tailings to be reinjected separately. In an embodiment, the waste stream can be injected at the bottom of the reservoir. In some embodiments, the waste stream may be injected into a deeper non-reservoir formation, for example, using the same set of backfilling wells. In some embodiments a separate set of wells may be used for the injection. The waste stream may be injected using techniques similar to standard drilling waste injection, for example, via fracturing of the injection interval followed by injection of the tailings stream. The injection of either or both streams may be done intermittently, such as if the composition of the tailings change and a waste stream is no longer generated.

Further, the injection procedures described herein, can be used to optimize the injection of the waste stream to minimize or even eliminate the need for fine tailings to be left on the surface. This can be done without hindering the injection of the backfilling stream needed for the slurrified heavy oil recovery process to work.

FIG. 1 is a diagram showing an embodiment of a slurry stream mixing and injection process 100. A coarse particle stream 102 can be characterized by total (fluid and solid) volume flow rate, $\dot{Q}_1$, the solids volume concentration, $c_1$, solids permeability, $k_1$, and characteristic solids diameter, $d_1$, in meters. The characteristic solids diameter can be related to a measured permeability to water, $k_1$, and volume concentration, $c_1$, by the Blake-Kozeny equation, shown as Eqn. 1.

$$d_1 = \left[\frac{k_1 150(1 - c_1^2)}{c_1^3}\right]^{1/2} \quad \text{Eqn. 1}$$

In such content, the diameter $d_1$ can be called a permeability diameter. As an example, the known permeability and concentration of clean Athabasca sand provides a value for $d_1$ in the range of about 70 μm about 80 μm. A fines particle stream 104 can be characterized by a corresponding set of variables, $\dot{Q}_2$, $c_2$, $k_2$, and $d_2$. The typical permeability diameter of fines, $d_2$, is about 10 μm.

The resulting or mixed slurry 106 can be formed by combining the coarse particle stream 102, the fines particle stream 104, and a fluid only stream 108, which can be characterized by a fluid flow rate $\dot{Q}_{f3}$. The fluid flow rate $\dot{Q}_{f3}$ can be positive when a fluid, such as water, is added to tailing streams, termed, "watering." It may also be negative when a fluid, such as water, is removed from the tailings streams, which may be termed "dewatering". Either addition or removal of fluid ($\dot{Q}_{f3}$) to either or both tailing streams may be performed before they are mixed together or after they are mixed together.

Various embodiments described herein use the fundamental fluid and solids mass conservation laws of the steady state flow. The mass conservation laws for the solid and fluid phases, respectively, are shown in Eqn. 2.

$$\dot{Q}_1 c_1 + \dot{Q}_2 c_c = \dot{Q}_4 c_4$$

$$\dot{Q}_1(1-c) + \dot{Q}_2(1-c_2) = \dot{Q}_4(1-c_4) - \dot{Q}_{f3} \qquad \text{Eqn. 2}$$

The conservation laws shown in Eqn. 2 can be extended to a general case of N tail streams mixing together. In the general case, the solid and fluid mass conservation equations from Eqn. 2 are as shown in Eqn. 2A.

$$\sum_{i=1}^{N} \dot{Q}_i c_i = \dot{Q} c \qquad \text{Eqn. 2A}$$

$$\sum_{i=1}^{N} \dot{Q}_i (1 - c_i) = \dot{Q}(1 - c) - \dot{Q}_f$$

In Eqn. 2A, $\dot{Q}$ represents a mixed slurry stream flow rate, corresponding to the stream $\dot{Q}_4$, in Eqn. 2 and displayed in FIG. 1, as mixed slurry stream 106. The volume concentration of the solids in Eqn. 2A is represented by c, which corresponds to $c_4$ in Eqn. 2. The watering/dewatering rate in Eqn. 2A is represented by $\dot{Q}_f$, which corresponds to $\dot{Q}_{f3}$ in Eqn. 2.

In general, the system in Eqn. 2A can be considered as incomplete as only two independent equations for N+1 unknown flow rates ($\dot{Q}_{i=1,N}, \dot{Q}_f$) are present. Therefore, the two equations in Eqn. 2A can be complemented by information about the desired solid size composition of the mixed slurry, which is characterized by N−1 known solid volume fractions $$\left\{ f_i,\ i = \overline{1, N-1},\ f_N \equiv 1 - \sum_{i=1}^{N-1} f_i \right\}$$

of the i-th tail stream in the mixed stream, as shown in Eqn. 3.

$$f_i = \frac{\dot{Q}_i c_i}{\sum_{i=1}^{N} \dot{Q}_i c_i},\ i = \overline{1, N-1} \qquad \text{Eqn. 3}$$

The solution of the linear system represented by Eqns. 2A and 3 is shown in Eqn. 4.

$$\dot{Q}_i = \frac{\dot{Q} c f_i}{c_i} \qquad \text{Eqn. 4}$$

-continued $$\dot{Q}_f = \dot{Q}\left[1 - c\sum_{i=1}^{N} \frac{f_i}{c_i}\right]$$

The formulas shown in Eqn. 4 provide flow rates for tailings streams plus fluid flow rate. These stream rates are computed given the volume concentrations of the streams and desired mixed slurry rate $\dot{Q}$ and its volume concentration, c.

Simplifying the general solution shown in Eqn. 4 to the case of coarse particle stream 102 and fines particle stream 104 leads to the formulas shown in Eqn. 5.

$$\dot{Q}_1 = \frac{\dot{Q}_4 c_4 (1 - f_4)}{c_1} \qquad \text{Eqn. 5}$$

$$\dot{Q}_2 = \frac{\dot{Q}_4 c_4 f_4}{c_2}$$

$$\dot{Q}_{f3} = \dot{Q}_4\left[1 - c_4\left(\frac{(1 - f_4)}{c_1} + \frac{f_4}{c_2}\right)\right]$$

In Eqn. 5, $$f_4 = \frac{\dot{Q}_2 c_2}{\dot{Q}_1 c_1 + \dot{Q}_2 c_2},$$

which is the known fines content related to the mixed stream permeability. Thus, the permeability of the mixed stream 106 may be most affected by the fines particle stream 104.

In an embodiment, Eqns. 4 and 5 may be used to provide a basis of the solid size distribution control dictated by known solid volume fraction from each slurry stream. The solid size distribution of the mixed stream 106 may determine its permeability. Thus, permeability of the mixed stream 106 can be controlled by the mixing of slurries 102 and 104 containing two or more differently sized solid particle distributions. However, if more fines are recovered from a reservoir than needed, the use of the entire amount of the fines particle stream 104 in the mixed stream 106 may result in a permeability that is too low. Accordingly, some of the fines particle stream 104 may be left over after the mixed stream 106 is formed. In an embodiment, the excess portion of the fines particle stream 104 may be injected into a subsurface formation as a waste stream 110. This waste stream 110 may be injected into the reservoir formation 112, along with the mixed stream 106, or may be injected into another formation 114, such as formation below the reservoir formation 112.

Slurrified Reinjection of Tailings

Some embodiments of current invention include various mining or civil engineering operations which rely on backfilling (or reinjection or replacement) of part or the whole of material produced from the subsurface formation. In particular, in situ heavy oil mining operations, such as the slurrified hydrocarbon extraction process shown in FIG. 2, may benefit from the current invention.

Figure 2:
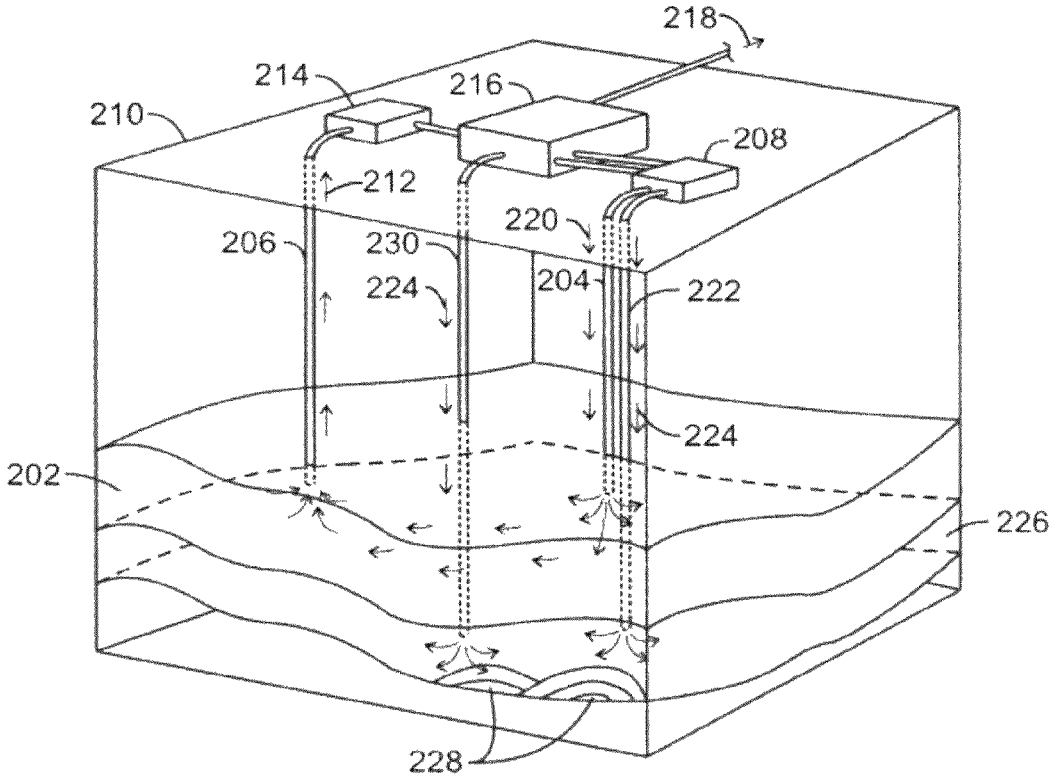
FIG. 2 is a diagram showing the use of a slurrified hydrocarbon extraction process to harvest hydrocarbons from a reservoir, such as an oil-sands deposit, wherein a waste portion of one slurry stream is injected through a different pipe.

FIG. 2 is a diagram showing the use of a slurrified hydrocarbon extraction process to harvest hydrocarbons from a reservoir, such as an oil-sands deposit, wherein a waste portion of one slurry stream is injected through a different pipe. However, the techniques described herein are not limited to the slurrified hydrocarbon extraction process but may be used with any number of other mining processes. In the diagram 200, a reservoir 202 is accessed by an injection well 204 and a production well 206. The reservoir can be a subsurface formation that may be at a depth greater than about 50 meters. Water and tailings are injected through the injection well 204, for example, from a pumping station 208 at the surface 210. At the same rate, hydrocarbon containing materials 212, such as oil sands, are harvested from the reservoir 202, for example, through another pumping station 214. The hydrocarbon containing materials 212 may be processed in a facility 216 to remove the hydrocarbons 218. The hydrocarbons 218 can be sent to other facilities for further refining.

A portion of the cleaned tailings 220, may then be backfilled, i.e., reinjected, into the reservoir 202 through the injection well 204, for example, to prevent subsidence of the surface 210. The injection and production wells may be in single lines to the reservoir 202, but multiple wells may be used. In an embodiment, a waste injection well 222 may be placed in proximity to the injection well 204, for example, combined within the same borehole, to inject excess or waste tailings 224 from the separation and blending processes into another subsurface formation 226. The injected waste tailings 224 may form a dome 228 which may assist in slowing or preventing subsidence of the surface due to removal of the hydrocarbons from the mixture 212. The injection of the waste tailings 224 does not have to be performed using the same wellbore, as a separate waste injection well 230 may be used in embodiments. The possible arrangements of injection, production, and waste injection wells are further illustrated by FIG. 3.

Figure 3:
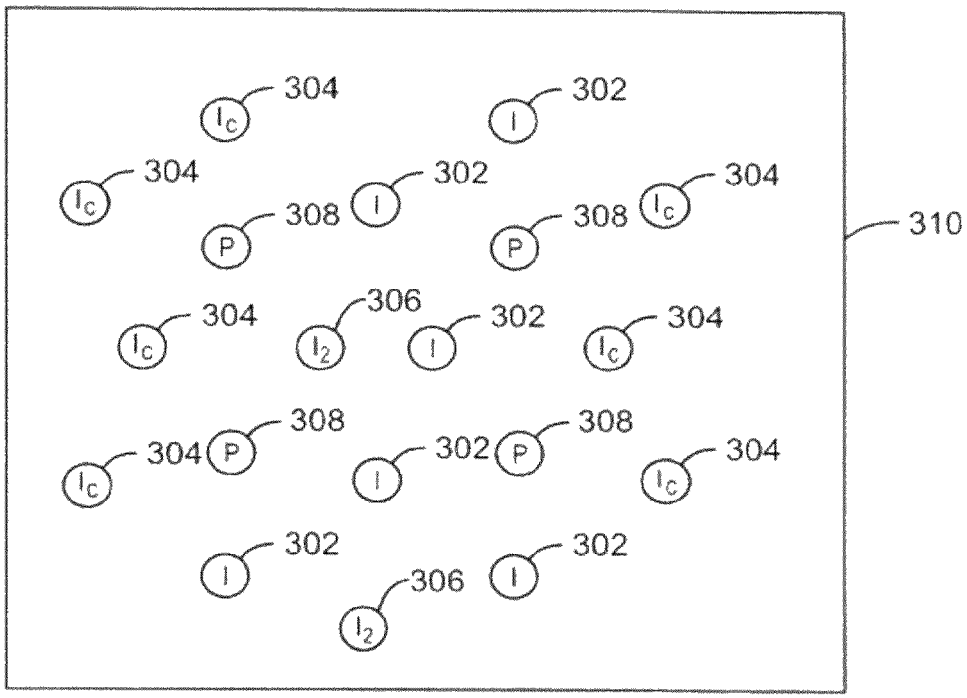
FIG. 3 is a diagram showing a pattern of injection wells, combined injection wells, waste injection wells, and production wells over a hydrocarbon field 306.

FIG. 3 is a diagram showing a pattern 300 of injection wells 302, combined injection wells 304, waste injection wells 306, and production wells 308 over a hydrocarbon field 306. As used herein, the combined injection wells 304 can include two pipes, one for injection of a mixed slurry, and one for injection of a waste slurry, in a single borehole. The injection wells 302 are generally used only for injection of the mixed slurry. Generally, the number of injections wells 302 and combined injection wells 304 may be matched to the number of production wells 308 to assist with maintaining a mass balance of material entering and exiting the reservoir. Separate waste injection wells 306 may be used in addition to, or instead of, the combined injection wells 304. As shown in FIG. 3, the injection wells 302, combined injection wells 304, and production wells 308 pattern may be regularly spaced across a field. In other embodiments, the wells 302, 304, 306, and 308 may be irregularly spaced, for example, placed to interact with the reservoir geometry. Any number of other patterns may be used in embodiments.

Injection of Waste Tailings into Reservoir Formation

As mentioned herein, several options exist for the injection of the waste stream. In an embodiment, the waste stream may be injected into the reservoir formation through a combined injection well, as discussed with respect to FIG. 4. Further, the waste stream may be injected into an alternate formation through a combined injection well, as discussed with respect to FIG. 5. In various embodiments, the waste stream may be injected into an alternate formation through a separate well. Generally, the alternate formation will lie below the reservoir formation, in a substantially vertical alignment, allowing the injected material to decrease or prevent subsidence from the mining process. It will be clear that embodiments are not limited to the combinations discussed here, as any combinations of combined injection wells and separate injection wells may be used to place the waste stream into the reservoir formation, the alternate formation, or both.

Figure 4:
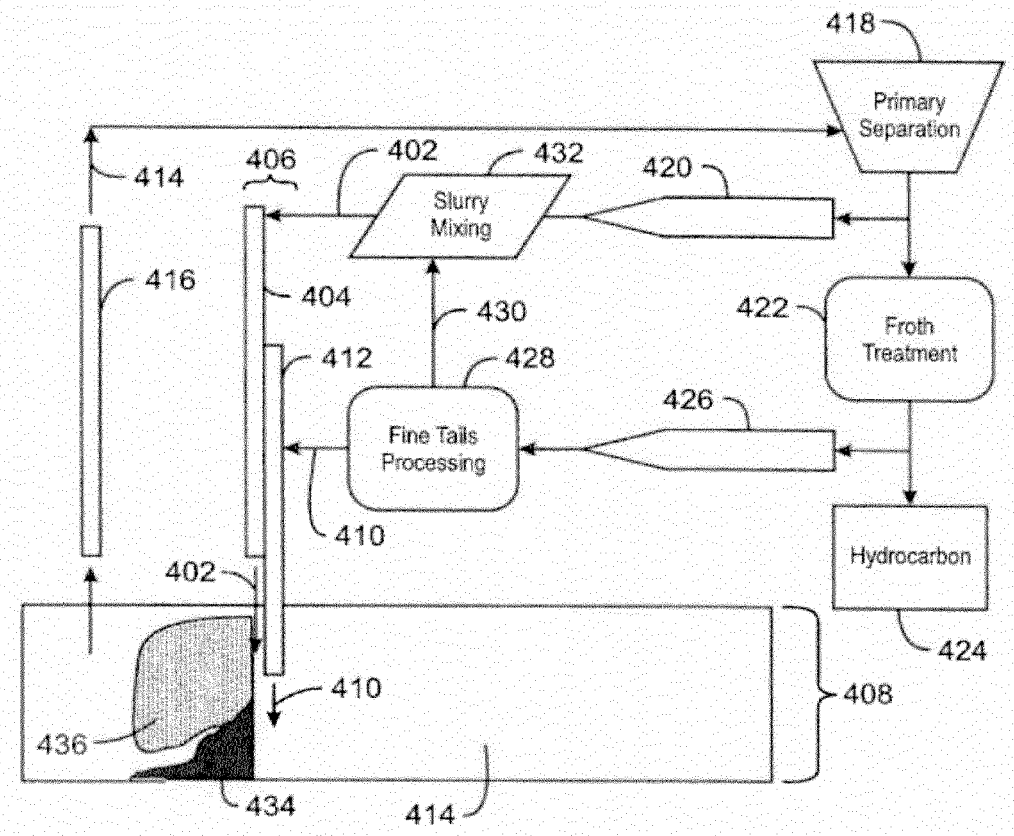
FIG. 4 is a schematic illustrating the injection of a mixed slurry through a first pipe in a combined injection well into a reservoir formation, and the injection of a waste slurry through a second pipe in the combined injection well into the reservoir formation.

FIG. 4 is a schematic 400 illustrating the injection of a mixed slurry 402 through a first pipe 404 in a combined injection well 406 into a reservoir formation 408, and the injection of a waste slurry 410 through a second pipe 412 in the combined injection well 406 into the reservoir formation 408. Although the techniques described herein are not limited to a slurrified hydrocarbon extraction process, the process provides a convenient example. In the example, the reservoir formation 408 holds a mixture 414 of heavy hydrocarbons, such as bitumen, with sand, clay, or other materials. A production well 416 may be used to extract the mixture 414 from the reservoir formation 408, for example, under the force of the water that is conveying the mixed slurry 402 into the reservoir formation 408 through the first pipe 404.

The mixture 414 is sent through a series of separation steps to separate the hydrocarbons and the other materials. The separation steps may be based on the Clark hot water extraction process, among others. For example, a primary separation process 418, may remove at least a portion of coarse particles or tailings from the mixture 414, creating a coarse tailings stream 420. A froth treatment 422 may then be used to separate a purified hydrocarbon stream 424 from a fine tailings stream 426. The fine tailings stream 426 may be subjected to further processing 428, for example, to remove another portion of hydrocarbons.

A portion 430 of the fine tailings from the processing 428 may be mixed with the coarse tailings stream 420 in a slurry mixing process 432 to form the mixed slurry 402 that can be reinjected into the reservoir formation 408. As described with respect to FIG. 1, the amount of fine and coarse tailings in the mixed slurry 402 can be controlled in the slurry mixing process 432 to adjust the permeability and density of the mixed slurry 402. This control can ensure that water will flow through the mixed slurry 402 and convey the mixture 414 out the production well 416.

However, as noted above, the amount of fines needed to achieve a target permeability range may be less than the amount of fines produced as the fines tailings stream 426. In various embodiments, the excess fines may be injected as the waste stream 410 into the reservoir formation 408 for disposal, for example, through the second pipe 412, which may be configured to extend to a lower level of the reservoir formation 408. In an embodiment, the injected fines may form a slope or dome 434 in the reservoir formation 408, which may improve the flow 436 of the mixed slurry 402 into the reservoir formation 408 and decrease subsidence. The amount of subsidence may be measured at the surface, and the amount of fines injected as the waste stream 410 may be adjusted to help control the subsidence. The waste stream 410 does not have to be injected into the reservoir formation 408. In some embodiments, the waste stream 410 may be injected into another formation, as discussed with respect to FIG. 5.

Figure 5:
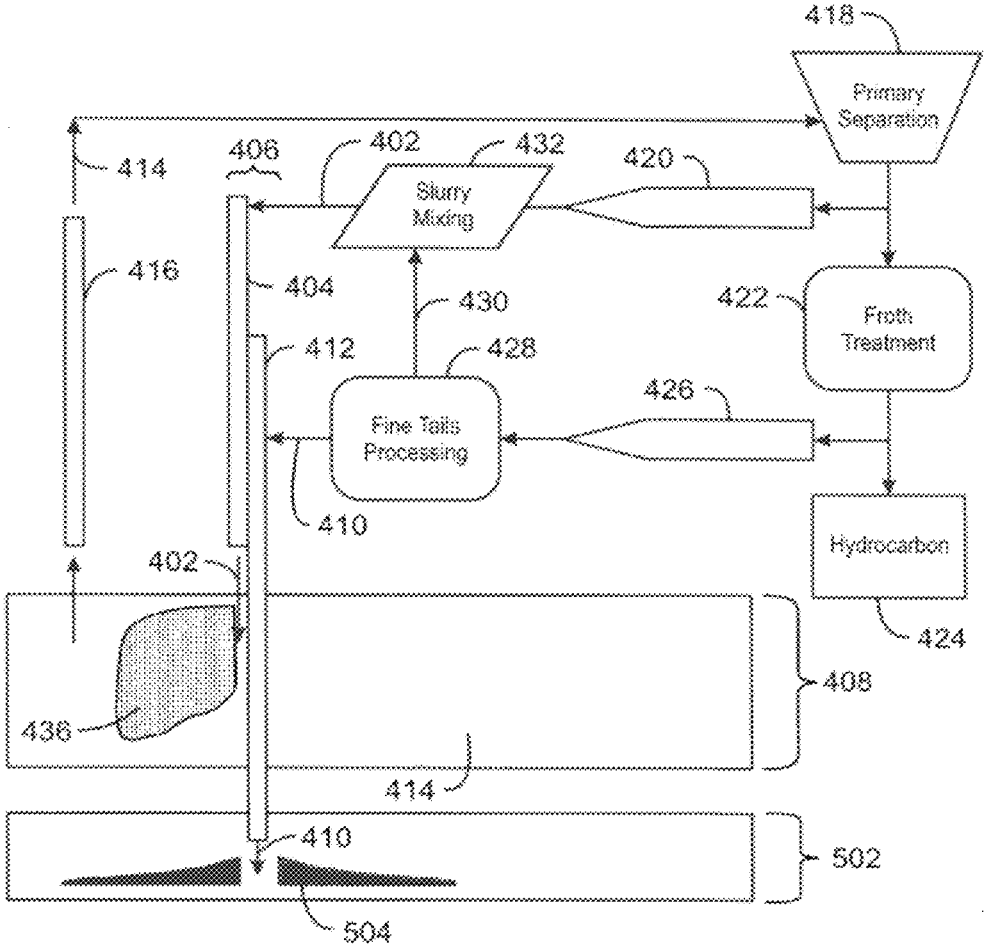
FIG. 5 is a schematic illustrating the injection of a mixed slurry through a first pipe in a combined injection well into a reservoir formation, and the injection of a waste slurry through a second pipe in the combined injection well into a non-reservoir formation.

FIG. 5 is a schematic 500 illustrating the injection of a mixed slurry 402 through a first pipe 404 in a combined injection well 406 into a reservoir formation 408, and the injection of a waste slurry 410 through a second pipe 412 in the combined injection well 406 into a non-reservoir formation 502. In FIG. 5, like numbered items are as described with respect to FIG. 4. In the schematic 500, dual-completion injectors, i.e., injection wells that can flow two separate streams from the surface to different subsurface targets, can be used to access two separate downhole horizons, the reservoir formation 408 and a non-reservoir formation 502. Accordingly, in this embodiment, the reservoir formation 408 only receives the mixed slurry 402 to support the slurrified hydrocarbon extraction process. A non-reservoir formation 502, for example, a deeper, non-hydrocarbon bearing zone, may be used for the injection of the fines-only stream in a manner similar to the drilling waste injection in FIG. 4. As for the injection of the waste stream 410 into the reservoir formation 408, discussed with respect to FIG. 4, injection of the waste stream 410 into a deeper non-reservoir formation 502 may form an uplifted region or dome 504 that may decrease or prevent subsidence. Embodiments are not limited to using a combined injection well 406 for both injections.

Figure 6:
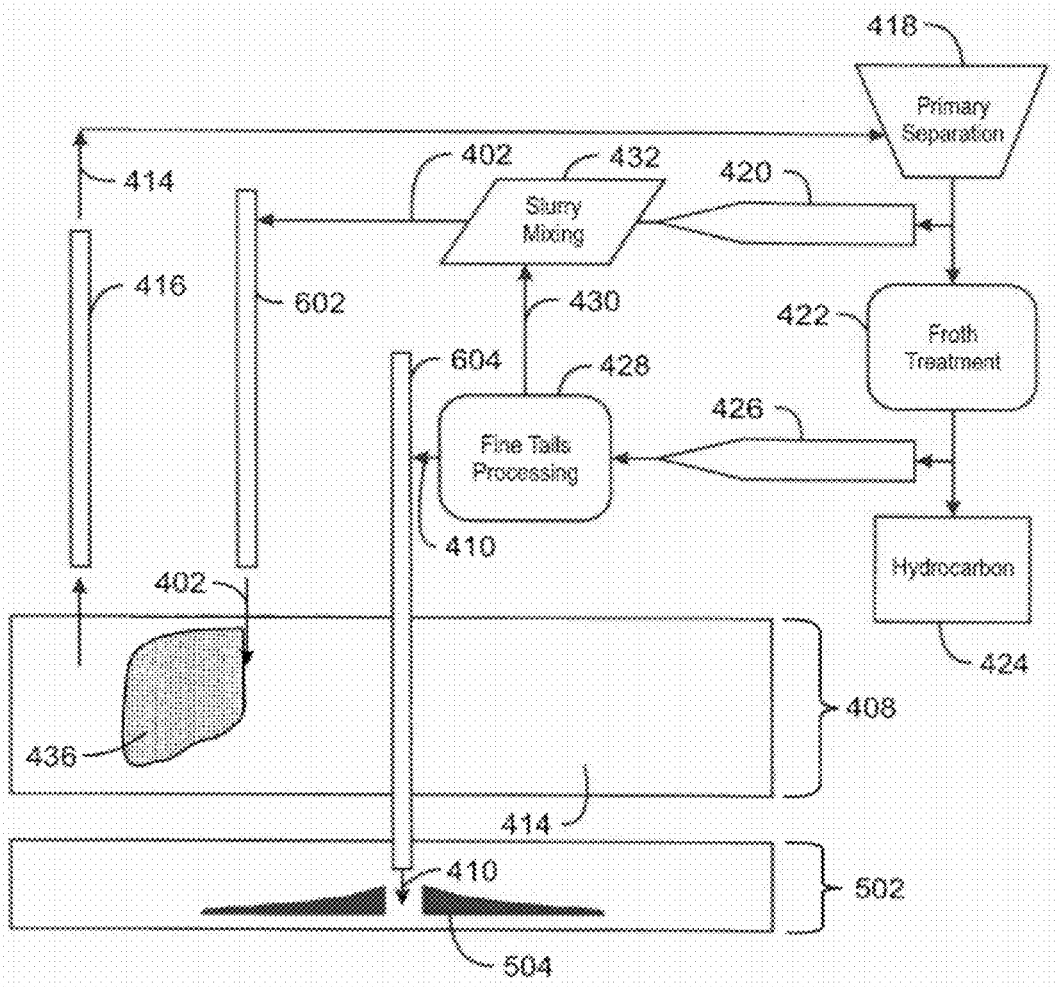
FIG. 6 is a schematic illustrating the injection of a mixed slurry into a reservoir formation through a slurry injection well, and the injection of a waste slurry into a non-reservoir formation through a waste injection well.

FIG. 6 is a schematic 600 illustrating the injection of a mixed slurry 402 into a reservoir formation 408 through a slurry injection well 602, and the injection of a waste slurry 410 into a non-reservoir formation 502 through a waste injection well 604. Like numbered items are as discussed with respect to FIGS. 4 and 5. The waste injection well 604 is not limited to injecting the waste stream 410 into a non-reservoir formation 502, but may be used to inject the waste stream 410 into the reservoir formation 408, for example, to push the mixture 414 from edges of the reservoir formation 408 towards a production well 416 in a more central location of the reservoir formation 408.

It will be clear to those of skill in the art that the embodiments discussed with respect to FIGS. 4-6 are merely examples. Embodiments may include any combinations of combined injection wells 406, slurry injection wells 602, waste injection wells 604, for a dual injection of the mixed slurry 402 and the waste stream 410.

Further, in some embodiments, the techniques presented above can be modified. For example, in an embodiment, a small amount of coarse material may be added to the "fines" stream for improving handling or injectivity. In another embodiment, the injection of the fines stream into a reservoir can be used for conditioning. In an embodiment, the waste stream 410 may be injected into just a few of the injection wells. This may be used to compensate for the lower amount of fines that need to be injected, as the total volume of the waste stream 410 may be only 5-15% of the total volume of the backfill injection stream. Further, the injection of the waste stream 410 may be intermittently performed only when needed to dispose of excess fines. In other embodiments, the volume of the waste stream 410 may be in excess of 20% of the backfill stream due to its low solids/water ratio, thus, using more combined injection wells 406 and waste injection wells 604 for disposal. In some embodiments, one or both injection streams may be partially dewatered to lower the total amount of water injected. The water used to form the streams does not have to be fresh, but may be brine solutions recovered from the reservoir formation 408, or other convenient formations or surface sources.

FIG. 7 is a block diagram of a method 700 for dual injection of a mixed slurry and a waste slurry. The method 700 begins at block 702 with a determination of the optimum rheological behavior, for example, using the methods discussed above with respect to Eqns. 1-5. Referring also to FIG. 4, at block 704, the ratio of a coarse tailings stream 420 to a fine tailings stream 426, and the water content used to reach the rheological behavior is adjusted, for example, in the slurry mixing process 432. At block 706, the flow rate of the mixed slurry 402 into the reservoir formation 408 is set or adjusted. At block 708, the mixed slurry 402 is injected into the reservoir formation 408. At block 710, the remaining fines may then be formed into a waste stream 410 and injected into a reservoir formation 408, an underlying non-reservoir formation 502, or both. Process control then returns to block 702 to repeat the method 700. The method may be implemented in any number of systems, such as the control system discussed with respect to FIG. 8.

Exemplary Control System

FIG. 8 is a block diagram of a control system 800 that may be used to control a backfill and waste injection process. The control system 800 may be a distributed control system, a direct digital controller, a programmable logic controller, or any number of other types of systems. The control system 800 will generally have a processor 802 that is associated with a cache 804 and a memory 806, such as combinations of random access memory (RAM) and read-only memory (ROM). The memory 806 is a non-transitory, computer readable medium that may be used to hold programs associated with the techniques described herein, such as the method discussed with respect to FIG. 7 or the techniques described with respect to Eqns. 1-5.

A bus 808 may be used by the processor 802 to communicate with other systems, such as a storage system 810. The storage system 810 may include any combinations of hard drives, optical drives, RAM drives, holographic drives, flash drives, and the like. The storage system 810 provides another non-transitory computer readable medium that may be used to hold code for controlling the plant and implementing the techniques described herein. For example, the storage system 810 may hold a rheology module 812 for calculating a predicted rheology and flow rate for a backfilling mixture, as described with respect to Eqns. 1-5. Further, the storage system 810 may hold a mixture control module 814 that controls slurry pumps and/or watering/dewatering systems to change the composition and rheology of the backfill, for example, based on the results from the rheology module 812. The mixture control module 814 may also determine the amount of tailings that form a waste stream. The storage system 810 may also include a plant control system module 816 that operates the specific plant equipment.

For example, the processor 802 may access the plant control system module 816 and use the module to communicate with a plant interface 818 through the bus 808. The plant interface 818 may include hardware, software, or both used to collect data from sensors 820, control pumps 822, open and close valves 824, and control motors 826 on equipment such as mixers, conveyors, vacuum pumps, and the like.

The plant control system 800 may have a human-machine interface 828 that allows operators to interface to the control system. The human-machine interface 828 may couple input and output devices, such as keyboards 830, displays 832, and pointing devices 834 to the bus 808.

The plant control system 800 may also include a network interface, such as a network interface card (NIC) 836 to allow remote systems 838 to communicate with the plant control system 800 over a network 840. The network 840 may be a local area network (LAN), a wide area network (WAN), the Internet, or any other appropriate network.

While the present techniques may be susceptible to various modifications and alternative forms, the exemplary embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

What is claimed is:

1. A method for disposing of waste during a hydrocarbon recovery process, the method comprising:

removing a mixture comprising hydrocarbons and particulate solids from a reservoir formation;

separating at least a portion of the hydrocarbons from the particulate solids;

separating the particulate solids into a plurality of streams comprising a fines particle stream and a coarse particle stream;

injecting a mixed slurry comprising the coarse particle stream and the fines particle stream through a first pipe into the reservoir formation;

controlling a permeability of the mixed slurry relative to a fluid of the reservoir formation by varying a concentration of the fines particle stream in the mixed slurry such that the coarse particle stream and only a first portion of the fines particle stream is in the mixed slurry and a second portion of the fines particle stream is in a waste stream; and injecting the waste stream comprising the second portion of the fines particle stream through a second pipe into a target formation, wherein the reservoir formation and the target formation lie in a substantially vertical line.

2. The method of claim 1, comprising injecting the waste stream at a lower depth than the mixed slurry.

3. The method of claim 1, comprising monitoring deformation at the surface in a substantially vertical line above the reservoir formation and controlling injection into the target formation to minimize surface deformation.

4. The method of claim 1, wherein removing the mixture comprising the hydrocarbons and the particulate solids from the reservoir formation is performed using a slurrification process.

5. The method of claim 1, comprising incorporating particulates obtained from another source into the waste stream prior to injection.

6. The method of claim 1, comprising injecting the mixed slurry, the waste stream, or both intermittently.

7. The method of claim 1, comprising minimizing an amount of water injected with the waste stream.

8. The method of claim 1, comprising forming the mixed slurry, the waste stream, or both from brine.

9. The method of claim 1, comprising adding water to the mixed slurry to control a rheological property of the mixed slurry, density of the mixed slurry, or both.

10. The method of claim 1, comprising injecting the waste stream into the reservoir formation below where the mixed slurry is injected.

11. The method of claim 1, comprising adding water to the waste stream to control a rheological property of the waste stream, density of the waste stream, or both.

12. The method of claim 1, comprising removing water from the waste stream to control a rheological property of the waste stream, density of the waste stream, or both.

13. The method of claim 1, comprising adding coarse particles to the waste stream to control a permeability of the waste stream relative to the reservoir formation.

14. A system for harvesting hydrocarbons from a reservoir, the system comprising:

a production well configured to convey a mixture from a reservoir formation, wherein the mixture comprises hydrocarbons and particulate materials;

a separation system configured to separate the particulate materials into a plurality of tailings streams comprising a fines particle stream and a coarse particle stream;

a mixing system configured to form a slurry mixture from the coarse particle stream and only a first portion of the fines particle stream and to form a waste stream from a second portion of the fines particle stream; and a first injection pipe configured to inject the slurry mixture into the reservoir formation; and a second injection pipe configured to inject the waste stream comprising the second portion of the fines particle stream into a target formation.

15. The system of claim 14, wherein the separation system is configured to separate the hydrocarbons from the particulate materials.

16. The system of claim 14, wherein the first injection pipe and the second injection pipe are placed in a single wellbore.

17. The system of claim 14, wherein the plurality of tailings streams comprises a coarse tailings stream and a fine tailings stream.

18. The system of claim 14, wherein the mixing system is configured to adjust a water content of the slurry mixture to achieve a target density.

19. The system of claim 18, wherein brine is used as a water source.

20. The system of claim 14, wherein the target formation is the reservoir formation.

21. The system of claim 14, wherein the waste stream is injected into the reservoir formation below the slurry mixture.

22. The system of claim 14, wherein the target formation is substantially vertically below the reservoir formation.

23. The system of claim 14, wherein the reservoir formation comprises bitumen.

24. The system of claim 14, wherein at least one of the slurry mixture and the waste stream comprises residual hydrocarbons.

25. A method for harvesting hydrocarbons from a reservoir, comprising:

drilling at least one injection well to a reservoir formation;

drilling at least one production well to the reservoir formation;

producing a material from the at least one production well, wherein the material comprises a mixture of particulate solids and hydrocarbons;

removing at least a portion of the hydrocarbons from the material to form a plurality of particulate streams;

separating the particulate solids into a plurality of streams comprising a fines particle stream and a coarse particle stream;

forming a mixture comprising the coarse particle stream and only a first portion of the fines particle stream, wherein the ratio of the first portion of the fines particle stream to the coarse particle stream is controlled to control a permeability of the mixture relative to a fluid of the reservoir formation;

forming a waste stream comprising a second portion of the fines particle stream;

controlling a water content of the mixture to control a rheological property of the mixture;

injecting the mixture through the injection well into the reservoir at substantially the same rate as production of the material from the reservoir; and injecting the waste stream comprising the second portion of the fines particle stream through an injection pipe.

26. The method of claim 25, comprising processing the at least the portion of the hydrocarbons removed from the material.

27. The method of claim 25, comprising drilling a separate injection well to a target formation for injecting the waste stream.

28. The method of claim 25, comprising injecting the waste stream and the mixture through separate pipes that are co-located in a single wellbore.

* * * * *